US008166902B2

(12) United States Patent
Rochfort

(10) Patent No.: US 8,166,902 B2
(45) Date of Patent: May 1, 2012

(54) BARGE SYSTEM

(76) Inventor: William P. Rochfort, Chula, GA (US)

( * ) Notice: Subject to any disclaimer, the term of this patent is extended or adjusted under 35 U.S.C. 154(b) by 342 days.

(21) Appl. No.: 12/568,665

(22) Filed: Sep. 28, 2009

(65) Prior Publication Data

US 2010/0083889 A1 Apr. 8, 2010

Related U.S. Application Data

(60) Provisional application No. 61/100,268, filed on Sep. 26, 2008.

(51) Int. Cl.
*B63B 35/38* (2006.01)
*B63B 35/44* (2006.01)
*B63B 3/06* (2006.01)

(52) U.S. Cl. ..... 114/266; 114/77 R; 114/249

(58) Field of Classification Search ..... 114/26–28, 114/31, 77 R, 77 A, 249–252, 263, 266, 267; 14/2.6, 27; 405/218–221
See application file for complete search history.

(56) References Cited

U.S. PATENT DOCUMENTS 4,060,048 A * 11/1977 Breheret et al. ..... 114/266
4,714,042 A * 12/1987 Schulte ..... 114/77 R
6,748,892 B1 * 6/2004 Rochfort ..... 114/266
* cited by examiner

*Primary Examiner* — Ajay Vasudeva
(74) *Attorney, Agent, or Firm* — Brian D. Bellamy

(57) ABSTRACT

An improved barge system comprises a barge with a connecting system built into the barge. The connecting system includes several recessed areas about the periphery of the barge with upper and lower tubes about the peripheral edges of the barge. A connecting system with a vertical post having a lower connecting member and an upper connecting member is attached within each recessed area. The vertical post and upper connecting member are separated hinged within the recess for rotation into position to connect an adjacent barge by connecting the upper and lower connecting members to adjacent upper and lower tubes on the adjacent barges. An adjustable hinge and wedged lower end of the connecting member is provided for alignment of the upper connecting member with the vertical post. A liner on the upper connecting member provides load absorption and noise abatement, and torsion bars on the barge provide structural control.

1 Claim, 9 Drawing Sheets

BARGE SYSTEM

PRIORITY CLAIM

The present application claims benefit of U.S. Provisional Patent Application No. 61/100,268 filed on Sep. 26, 2008.

BACKGROUND OF THE INVENTION

1. Field of the Invention

The present invention relates to an improved truckable, water born barge system and more particularly pertains to securing a plurality of barges with high efficiency connectors and improved load absorption and distribution.

2. Description of the Prior Art

The use of barges of known designs and configurations is known in the prior art. Previously, U.S. Pat. No. 6,748,892 to Rochfort disclosed a barge system devised having a plurality of barges in rectilinear configuration. Each barge included plates to define an upper periphery and a lower periphery. Tubes were provided around the upper and lower peripheries, and a plurality of vertically disposed recesses was formed in side, front and rear plates. A plurality of connectors was provided with each connector including a post and upper and lower ends. The lower ends included a downwardly facing inverted U-shaped member with a first portion of the lower end positioned upon a lower tube of one barge and a laterally disposed second portion positioned upon an adjacent lower tube of an adjacent barge. An upwardly facing U-shaped member on upper ends each were given a first portion positioned to receive an upper tube of one barge, and a laterally disposed second portion positioned to receive an adjacent upper tube of an adjacent barge. The barge system taught by Rochfort in '892 provided truckable barges capable of coupling together.

However, it has been recognized that a continuing need exists for a new and further improved barge system that can be used more efficiently while retaining the advantages of convenient and individually truckable barges. In this regard, the present invention provides high efficiency connectors and improved load absorption and distribution that reduce noise.

SUMMARY OF THE INVENTION

In view of the foregoing, an object of the present invention is to provide a more efficient system for coupling truckable barges. In particular, the present invention provides a connection system in which the connecting parts are self-contained within the separate barges.

Another object of the present invention is to increase load absorption by incorporating load bearing cushions between the barges in association with the connection system.

Another object of the present invention is to decrease noise when using modular barges while improving load absorption.

Another object is to make the system of connectors self-aligning so as to reduce manual labor and strain in aligning and connecting adjacent barges.

Another object is to reinforce the strength and security of the connection between coupled barges by self-alignment and securely wedging the connecting members into tightly fitting close relationship.

And yet another object is to provide a system for controlling twisting and ambiguity in the connected barges due to stress or heat distortion using a system of reinforcing torsion bars in association with the recessed pockets of the barge.

DETAILED DESCRIPTION OF THE INVENTION

With reference to the illustrations, the preferred embodiment of the new and improved barge system embodying the principles and concepts of the present invention will be described. In the present invention, the barge system is comprised of a plurality of previously described components illustrated in the prior barge system 110 of FIG. 14, now improved as illustrated in the remaining figures. Such components in their broadest context include individual barges, tubes, a plurality of vertically disposed recesses on the periphery of the each barge, and a plurality of connectors. A present system includes a plurality of barges provided in rectilinear configuration. A group or cluster of the barges can be placed together and connected.

Figure 14:
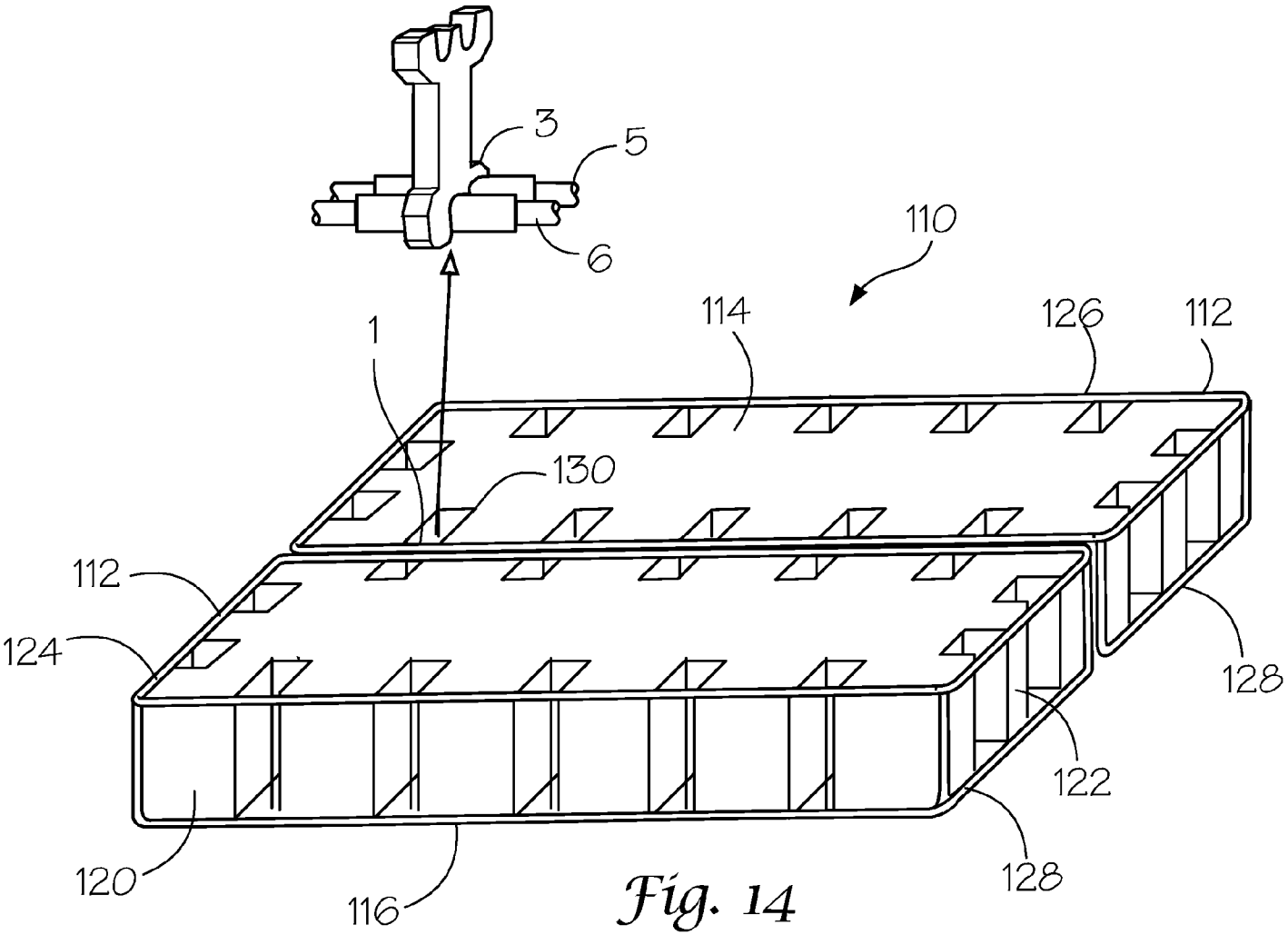
Fig. 14 PRIOR ART
FIG. 14 is a prior art barge connection system without improvements.
Figure 15:
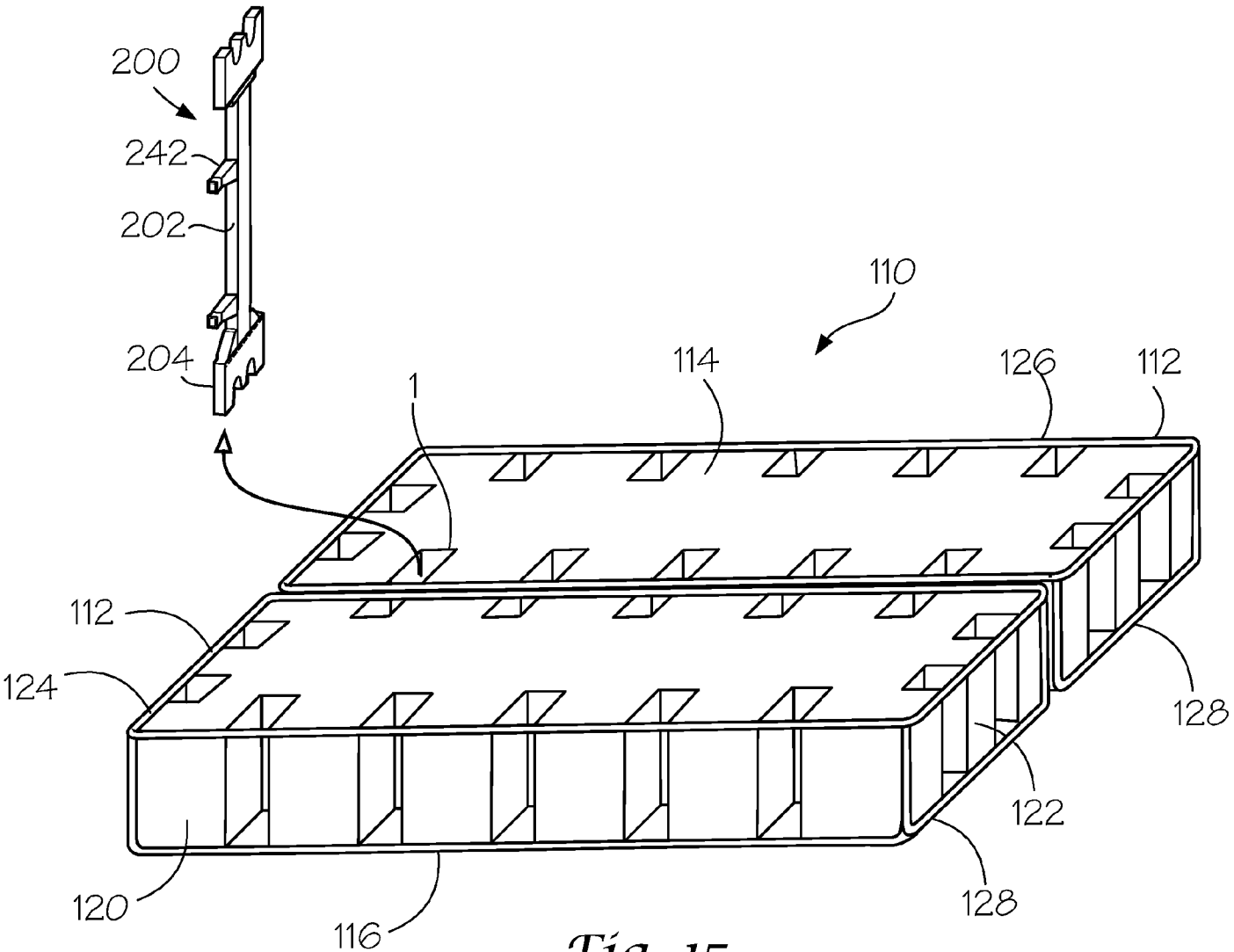
FIG. 15 is a perspective illustration of the improved barge connection system constructed in accordance with the principles of the present invention.

As shown in FIG. 14, each barge 112 has a horizontal rectilinear upper plate 114 and a parallel lower plate 116. The horizontal plates have long parallel side edges and short parallel front and rear edges. Each barge also has a pair of vertical parallel side plates 120 and vertical parallel front and rear plates 122, 124. The vertical plates have upper edges, and tubes 126 are attached at the upper edges near the upper plate. In this manner an upper periphery is defined. The vertical plates have lower edges, and tubes 128 are attached at the lower edges near the lower plate. In this manner, the lower periphery is defined.

A plurality of vertically disposed recesses 130 is provided. The recesses are formed in the vertical plates and the upper and lower plates. The recesses constitute pockets inwardly beyond the tubes. The recesses all have a common height equal to the height of the barge. The recesses each include an inside wall and opposing end walls, with the outer side open and exposing the recessed area.

Figure 1:
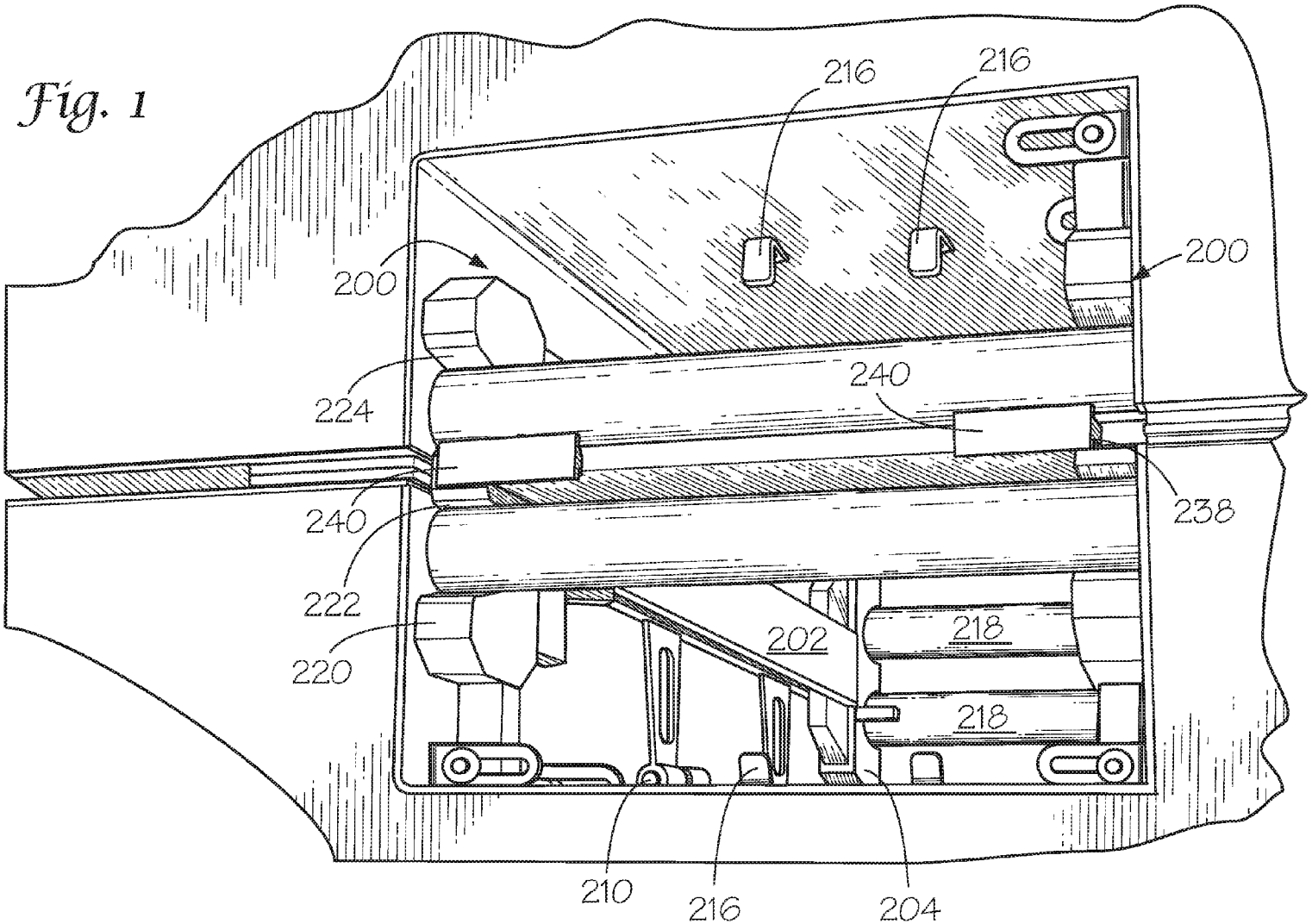
FIG. 1 is a top perspective view of a connector system for a barge.

As shown in FIG. 1, connectors 200 are provided in the recesses. Each connector includes a rectilinear vertical post 202 with a lower connector member 204. The vertical post has an upper end and lower end. The lower end of the vertical post has a downwardly facing M-shaped lower connector member having two first and second downwardly arched portions 206, 208. The vertical post is positioned and attached in adjacent recesses on opposing barges and positioned in the adjacent recesses in opposite corners. The vertical post pivotally rotates on an elongate axis shaft 210 that is attached to an end wall or the inside wall of the recess. The axis shaft includes a rod 212 extending through a cylindrical bracket 214. The rod lifts within the bracket to operate the rotatable vertical post. The vertical post is held on a hook 216, lifted upward, rotated into position above adjacent lower tubes 218 of adjacent barges, and lowered onto the adjacent lower tubes to connect the barges. The first arched portion is positioned upon a lower tube of one barge, and the second arched portion is positioned over a lower tube of an adjacent barge for coupling the barges.

Each connector also includes a separately upwardly facing W-shaped upper connector member 220 having two first and second upwardly arched portions 222, 224. The upper connector member is positioned and attached in adjacent recesses on opposing barges and positioned in the adjacent recesses in opposite corners. The upper connector member is attached to an upper axis shaft 226 situated above the vertical post. The upper axis shaft is attached to the end wall or near the end wall on the inside wall of the recess. The upper connector member pivotally rotates on the upper axis shaft via a hinge 228 comprised of rod 230 that extends through a bracket 232. The upper connector may be connected to the rod by an extendable linkage 234. Thereby, the linkage and brackets provide horizontal flexibility to enable alignment of the upper connector member with the vertical post and alignment of the upwardly arched portions under the upper tubes.

The upper connector member retracts downward on the hinge and rotates into position below the upper tubes and above and separated from the vertical post. The upper connector member has a lower end with an angular edge forming a wedge member 236. The horizontal flexibility of the linkage and bracket permits the upper connector wedge member to move into adjacent aligned relation to the top end of the vertical post. The upper connector member is moved securely into place above the vertical post and below the upper tubes. As the upper connector member is moved into place, the wedge member tightens the upper connector member and tightens the connection between the adjacent barges.

Also provided is a wedge 238. The wedge is positioned within a recess and gap between adjacent upper tubes coupled by the upper connectors. Each wedge is in contact at each end with one side of an upper connector member and has a T-bar 240 in contact with one side of the pockets at each end. In this manner the wedge and T-bar precludes axial displacement of the upper connector members along the upper tubes. When driven in between the upper tubes, the wedge also adds rigidness and stability to the connection of the barges.

Figure 2:
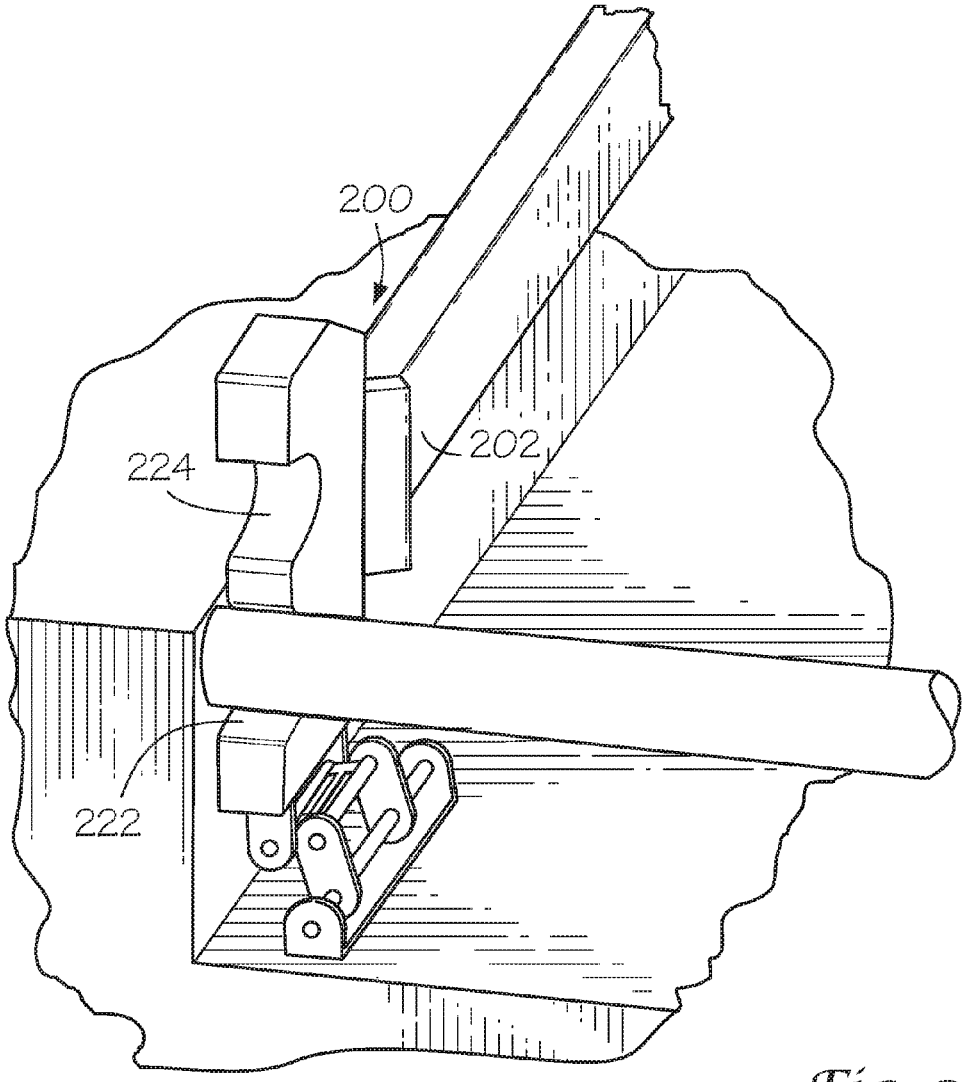
FIG. 2 is a top perspective view of a portion of a barge pocket including a portion of the connector system in accordance with the invention.

As shown in FIG. 2 showing the right hand corner of a barge pocket, the connector system for the barges includes an upper connector area. A portion of the vertical post 202 is shown for reference. The upper connector area includes the upper connector member 200, the upper axis shaft 226, hinge 228, and extendable linkage 234. The extendable linkage proves means to link the upper connector member via the hinge that is attached to the inside wall of the recessed pocket. The length of the hinge allows the upper connecting member to be raised and lowered to pass under the peripheral rail (upper tube) of the barge. The upper connecting member is then raised over the top of the vertical post of the lower connector system while maintaining a level plan for the whole upper connector system. Further, as it swings out from its captive position against the inner wall of the recessed pocket, there is attached to the hinge a three part extendable linkage that is shorter than the length of the hinge post or rod. The extendable linkage allows for longitudinal travel of the upper connection member so that the upper connection member (or locking plate) can be self centering as it captures the upper tube (or rail) as shown and the upper tube (or rail) of an adjacent barge.

Figures 3, 4, 5, 6, 7, 8:
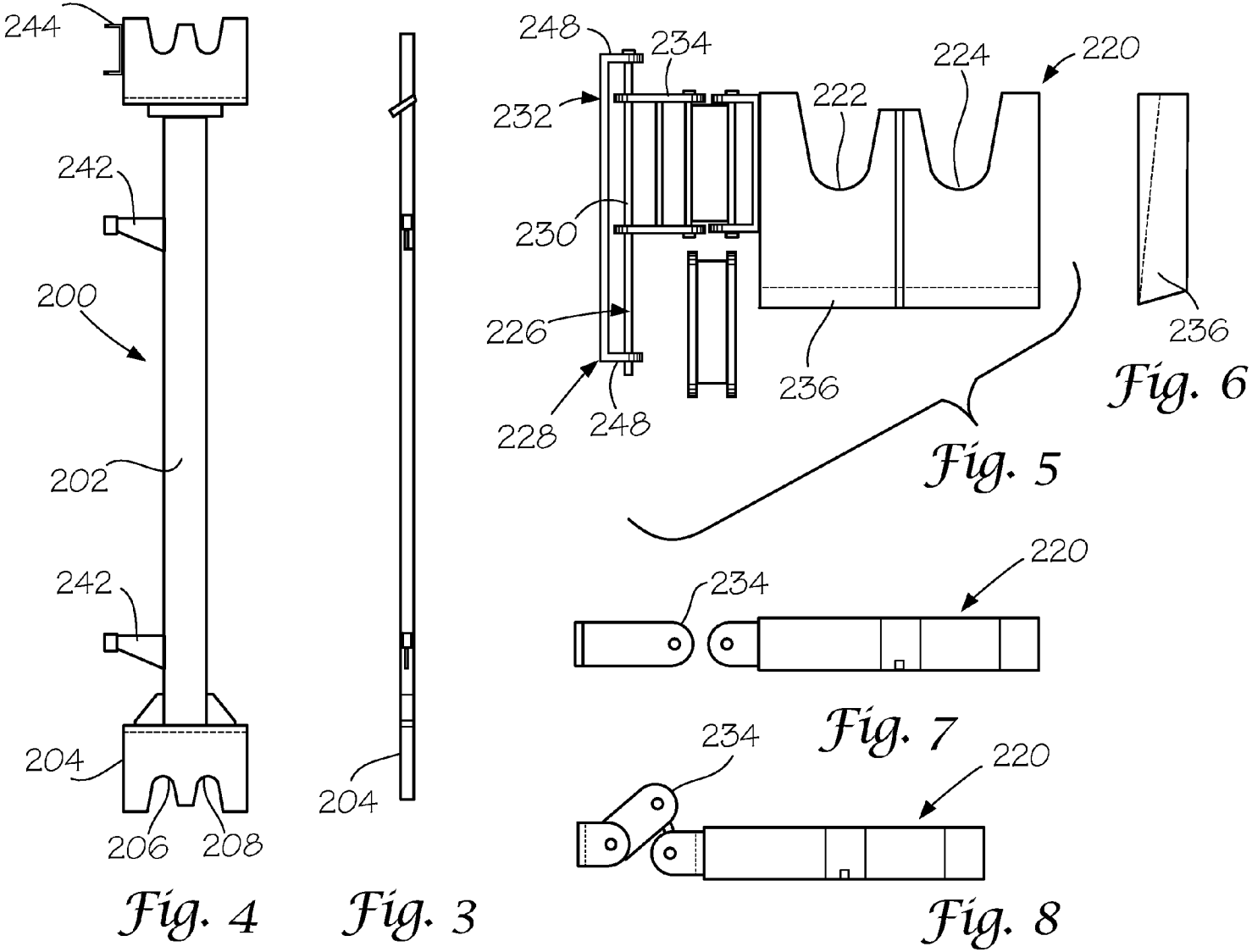
FIG. 3 is a side plan view of connectors of the invention.
FIG. 4 is a front plan view of the connectors.
FIG. 5 is front plan view of a connector, hinge and link of the invention.
FIG. 6 is a side plan view of the connector of FIG. 5.
FIG. 7 is a top plan view of the connector, hinge and link of FIG. 5.
FIG. 8 is an alternate top plan view of the connector, hinge and link of FIG. 5.

FIG. 3 shows the arrangement of features within each recessed pocket to store and capture the connector system inside of each pocket in each barge. FIG. 3 shows a left side view of upper and lower connecting members (or locking plates) with the vertical post attached to the lower connecting member. Collectively, the connecting members and vertical post features are referred to as a connector system. As a subset, there is an upper connector system including the upper connector member, and a lower connector system including the lower connector member.

FIG. 4 shows a pair of pivot arms 242 attached to the vertical post and a pivot bracket 244 attached to the upper connector member (or top locking plate). Note that the pivot arms have a tube 246 attached that has a larger bore size than diameter of the axis shaft 210 (¾ inch pin vs. 1¼ inch hole) to allow self-centering when connected to peripheral upper and lower tubes, said tubes also referred to or forming the character of rails about the periphery of a barge.

As shown in FIG. 5, the pivot arms 248 of the hinge that attaches to the back of the pocket have a large diameter hole to accept the axial shaft having a smaller diameter (¾ inch shaft vs. 1¼ inch hole). FIG. 6 shows a side view of the upper connector member, and FIGS. 7-8 showing the extendable linkage in alternate positions, extended and retracted. The extendable linkage allows the upper connecting member to move longitudinally for self-adjustment of the upper connecting member on the upper tubes, and the upper axis shaft allows the upper connecting member to move latitudinally for self-adjustment.

Figure 9:
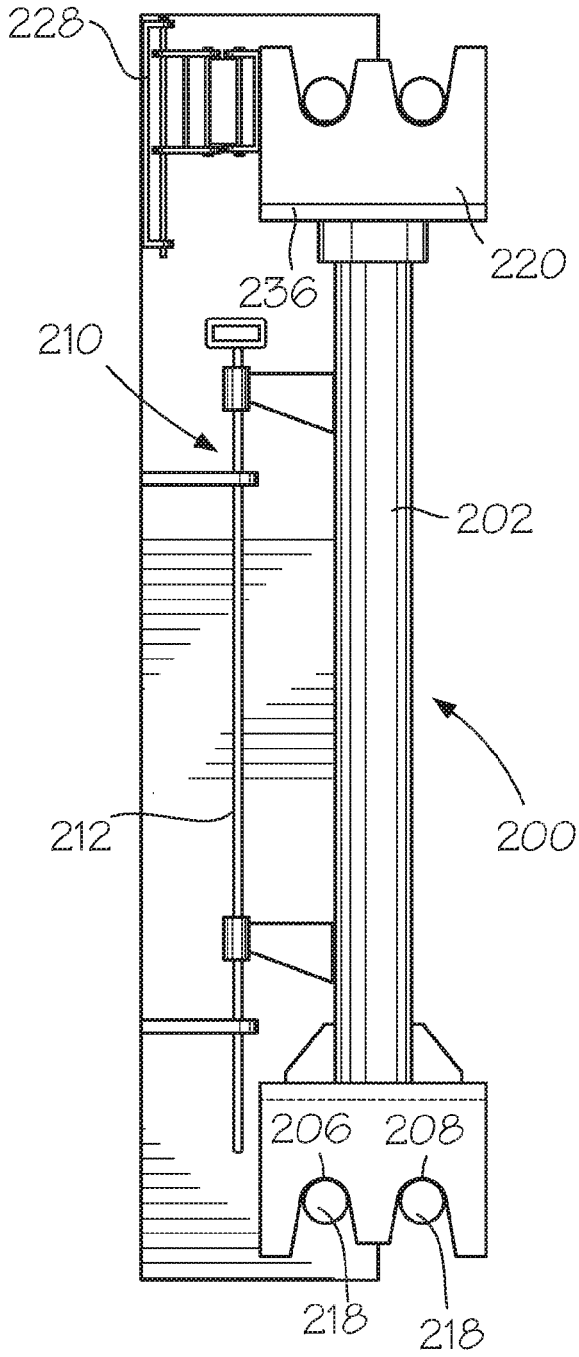
FIG. 9 is a side plan view of a recess of a barge with a connector system coupling a barge with an adjacent barge via upper and lower rails.
Figure 10:
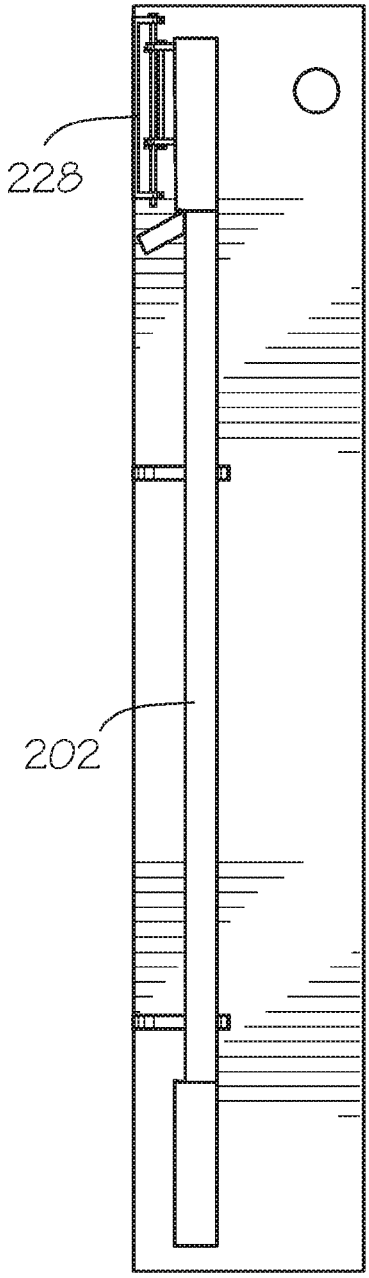
FIG. 10 is a side plan view of a recess as in FIG. 9 with the connector system in stored position.

FIG. 9 illustrates the connecting system in place as it is when connected to two sets of adjacent tubes (rails). The connecting system parts rotate back inward to a storage position against the inside wall of the recessed pocket for storage as shown in FIG. 10.

Figure 11A:
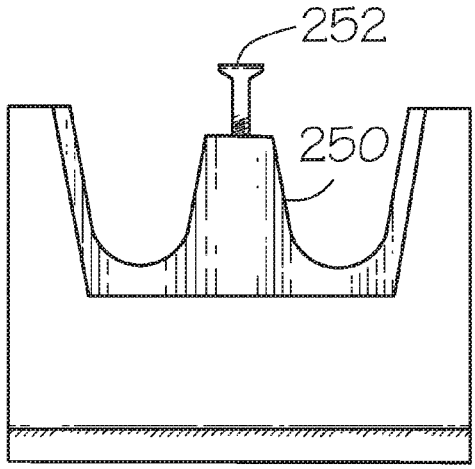
FIG. 11A is a front plan view of a connector member with liner in accordance with the invention.
Figure 11B:
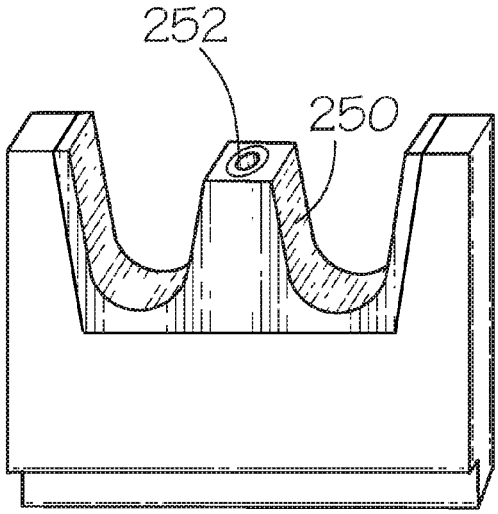
FIG. 11B is a perspective view of a connector member with liner.
Figure 11C:
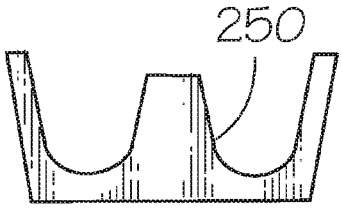
FIG. 11C is a front plan view of the liner of FIG. 11B.
Figure 11D:
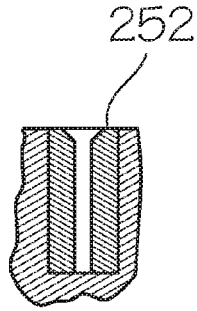
FIG. 11D is an end plan view of the liner of FIG. 11B.
Figure 11E:
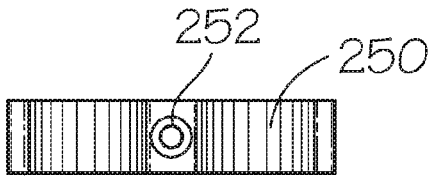
FIG. 11E is a top plan view of the liner of FIG. 11B.
Figure 12A:
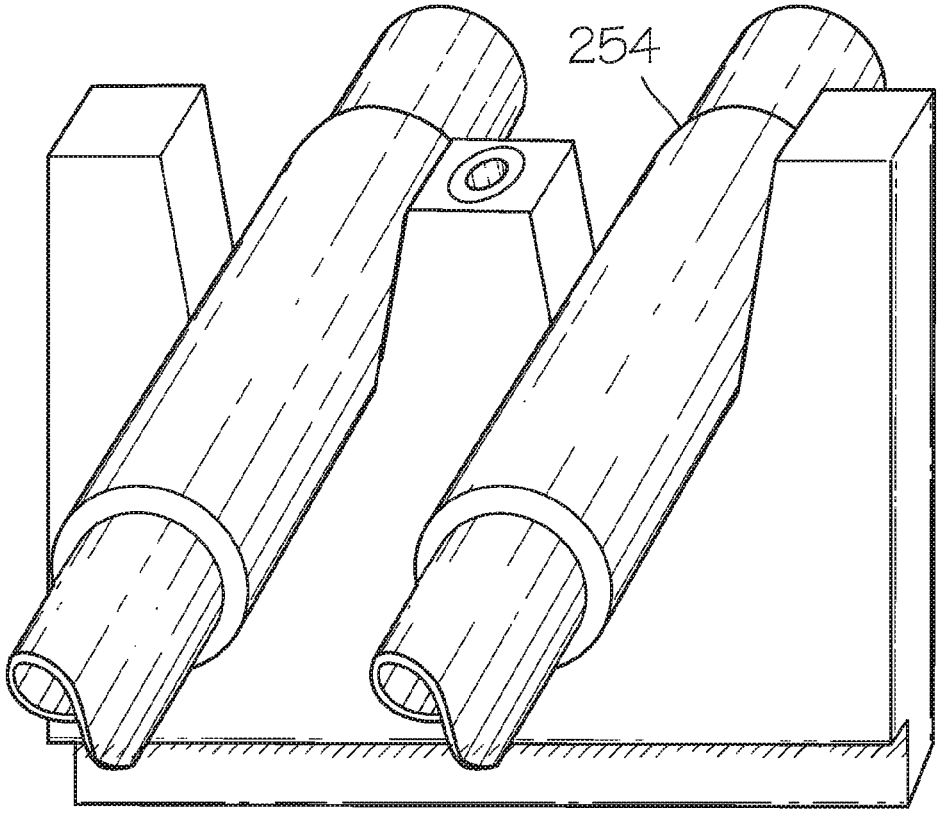
FIG. 12A is a perspective view of a tube liner in accordance with the invention.
Figure 12B:
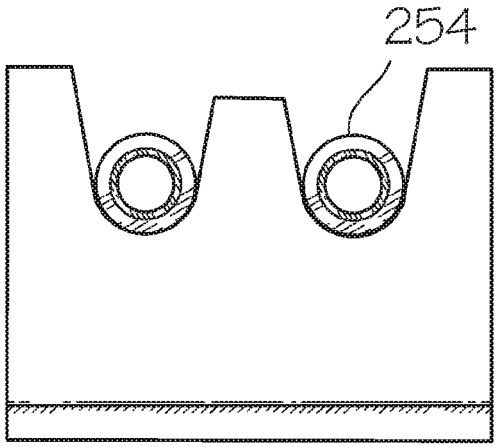
FIG. 12B is a front plan view of the tube liner of FIG. 12A and a connector member.
Figure 12C:
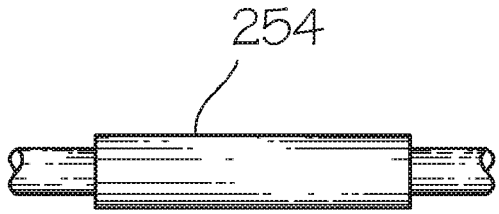
FIG. 12C is a perspective view of the tube line of FIG. 12A and a connector member.

A shock absorber, load distribution and noise abatement system is shown as a first preferred embodiment in FIG. 11A-11C. The shock absorber system incorporates the upper connecting member in combination with a synthetic liner 250 of a predetermined hardness that allows even distribution of loading across multiple connectors due to liner flexibility. The liners provide noise abatement when barges are loosely coupled together either, during joining together, or when leaving the barges without the connectors being tightly wedged to allow for flexibility when there is choppy water or deck machinery causing the barges to heave and sink. The liner may be attached to the upper connector member by a fastening device 252 as shown in FIGS. 11A and 11B. Alternatively, a cylindrical liner 254 may be attached to the upper tubes as shown in FIG. 12A-C.

Figure 13A:
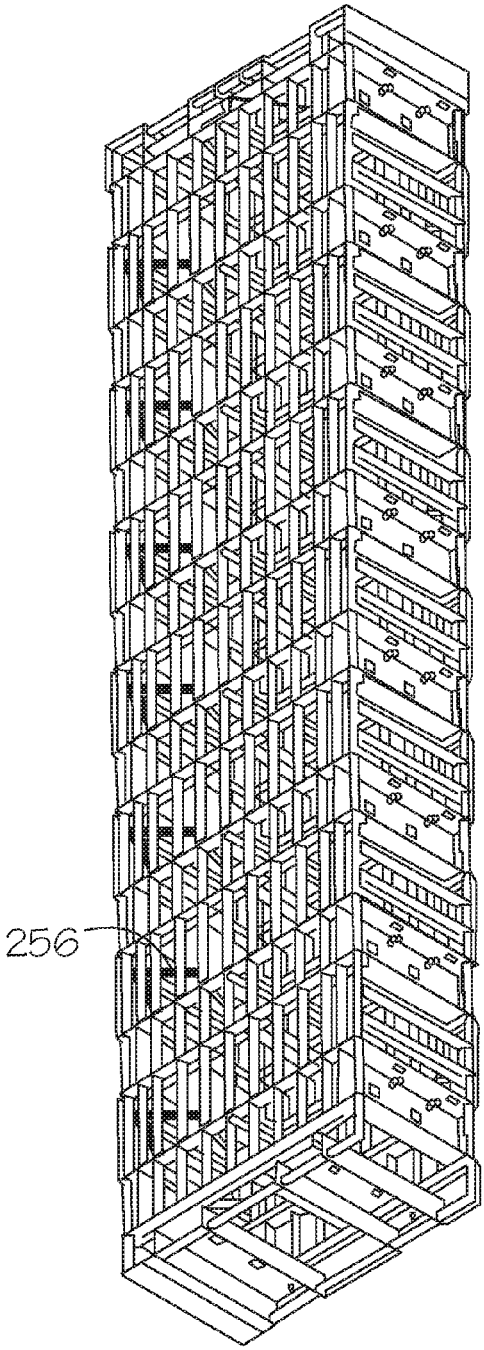
FIG. 13A is a perspective view of the torsion bar system in accordance with the invention.
Figure 13B:
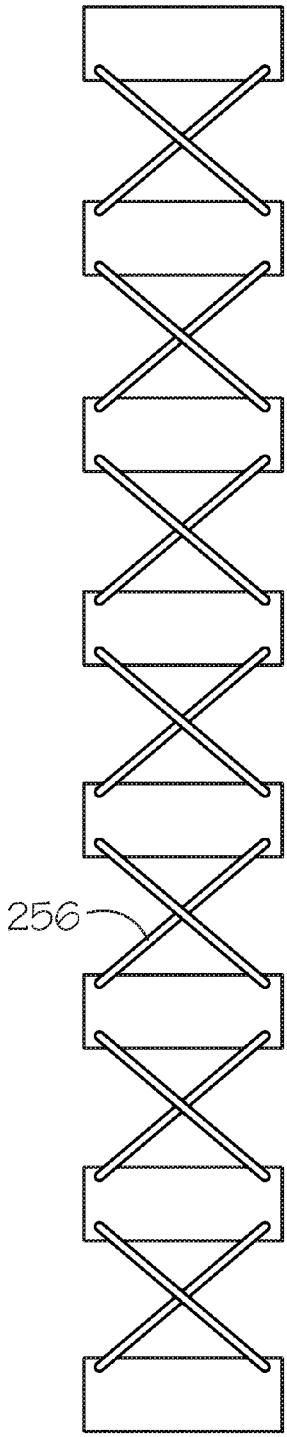
FIG. 13B is a plan view of the inside of the barge illustrating the torsion bar system of FIG. 13A.
Figure 13C:
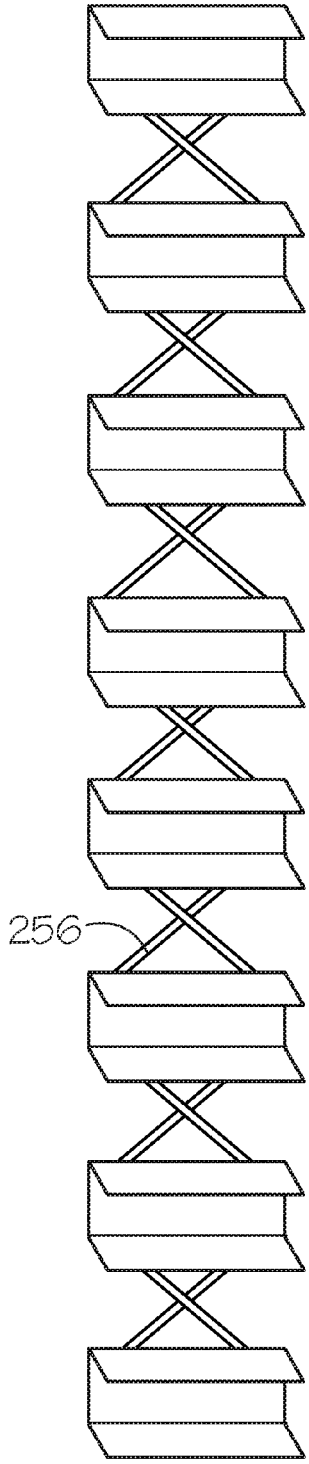
FIG. 13C is a perspective fragmentary view of the outside of the barge illustrating the torsion bar system of FIG. 13A.

The torsion bars 256 shown in FIGS. 13A-13C provide a system for controlling twisting and any ambiguity due to stress or heat distortion which interferes with connecting barges together. As shown, the torsion bars are attached in crossed relation on the back side of the inside wall of each recess.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A barge system comprising:

a barge in a rectilinear configuration with upper and lower plates and a pair of side plates and front and rear plates to define an upper periphery and a lower periphery;

upper tubes around the upper periphery and lower tubes around the lower periphery;

a plurality of recesses about the side plates of the barge system, the recesses having an associated upper tube and lower tube there adjacent; and connectors pivotally attached to inner walls of each of the recesses for coupling more than one barge together, the connectors coupling adjacent barges between the upper and lower tubes, each connector having a separately attached M-shaped lower connection member and a W-shaped upper connection member, the W-shaped upper connection member being pivotally attached in the respective recess for independent displacement relative to the respective connector.

* * * * *